United States Patent [19]

Luebering

[11] 4,033,705

[45] July 5, 1977

[54] BLADE RETAINER ASSEMBLY

[75] Inventor: George W. Luebering, Cincinnati, Ohio

[73] Assignee: The United States of America as represented by the Administrator of the National Aeronautics and Space Administration, Washington, D.C.

[22] Filed: Apr. 26, 1976

[21] Appl. No.: 680,067

[52] U.S. Cl. ..... 416/220 R; 416/221

[51] Int. Cl.[2] ..... F01D 5/32

[58] Field of Search ..... 416/220, 221, 219

[56] References Cited

UNITED STATES PATENTS

| | | | |
|---|---|---|---|
| 2,994,507 | 8/1961 | Keller et al. | 416/221 |
| 3,137,478 | 6/1964 | Farrell | 416/220 |
| 3,181,835 | 5/1965 | Davis | 416/221 X |
| 3,748,060 | 7/1973 | Hugoson et al. | 416/220 X |
| 3,888,601 | 6/1975 | Glassburn | 416/220 X |

*Primary Examiner*—Everette A. Powell, Jr.
*Attorney, Agent, or Firm*—N. T. Musial; Derek P. Lawrence; Henry J. Policinski

[57] ABSTRACT

A retaining assembly is provided for locking radially extending blades in a rotor disc associated with a gas turbine engine. The assembly includes a pair of spaced apart lugs axially extending from one side of the disc to form an access gap for insertion of a blade tang into a dovetail slot in the rotor disc. A pair of axially aligned inwardly facing recesses are disposed in the lugs. A retaining member resides in the recesses and extends across the gap to preclude egress of the blade tang from the dovetail slot. The retaining member includes at least one axially extending protrusion adapted to radially overlap and abuttingly engage a radially inwardly facing abutment surface on the lugs.

8 Claims, 7 Drawing Figures

BLADE RETAINER ASSEMBLY

The invention herein described was made in the performance of work under a NASA contract and is subject to the provisions of Section 305 of the National Aeronautics and Space Ace of 1958, Public Law 85-568 (72 Stat. 435; 42 USC 2457).

BACKGROUND OF THE INVENTION

The present invenion relates to turbomachines and, more particularly, to improved means for retaining rotor blades in rotor slots.

It is well known in the art that turbomachinery rotor assemblies are comprised of a plurality of circumferentially adjacent blades having tangs disposed in individual slots around the periphery of a rotor disc. Each blade is held in place by a retaining mechanism which serves to prevent axial migration and egress of the blade tang from the rotor slot while the rotor assembly is subject to the high centrifugal forces associated with rotation under engine operating conditions.

Many different and varied retaining mechanisms have been utilized in the past to retain the rotor blades securely affixed to the rotor disc. Some of these prior art mechanisms incorporated metal strips with bent ends and suffered from the disadvantage of being non-reuseable; that is to say, when the rotor assembly was disassembled, new locking mechanisms had to be installed as replacements for those which were repeatedly bent and flexed in prior installation and removal operations. These retaining mechanisms proved to be unreliable and their replacement at each disassembly was expensive. Other prior art retaining mechanisms were comprised of a multiplicity of components and hence assembly thereof into the rotor assembly was difficult and time-consuming Still other retaining mechanisms known in the prior art utilized elongated members with enlarged bearing lugs disposed at each end. The elongated member was disposed within the rotor disc slot between the blade tang and the bottom of the slot. The entire member, once in the slot, was rotated or translated into an installed position where the bearing lugs overlapped a portion of the rotor disc. Retaining mechanisms of this type exhibit load limits dependent upon the available space between the blade tang and the bottom of the disc slot. More specifically, the maximum loads which can safely be imposed upon the retaining mechanism are dependent upon the cross-sectional area of the elongated member. The maximum cross-sectional area of the member is limited by the available space between the blade tang and the bottom of the disc slot. Since the aforementioned available space is usually small, use of retaining mechanisms of this type are not readily applicable in instances where high loading of the retaining mechanism is anticipated.

Other retaining mechanisms in the prior art have been arranged to transfer some of the loads, associated with aerodynamic and centrifugal forces, to portions of the blade itself. Blade retainers of this type have not proven to be fully satisfactory since the blades utilized in such arrangements must be designed to accommodate the additional loads and as a result are bulky and heavy.

SUMMARY OF THE INVENTION

It is therefore an object of the present invention to provide an improved blade retaining mechanism which prevents axial migration and egress of the blade tang from the rotor slot while the rotor assembly is subjected to the high centrifugal forces associated with rotation of the rotor assembly under operating conditions.

It is still a further object of the present invention to provide such a blade retaining mechanism which is comprised of a minimum member of components and which may be installed in a readily expedient fashion.

It is yet another object of the present invention to provide a blade retaining mechanism which is reuseable in the event the blade must be removed for maintenance or repair purposes.

It is still yet another object of the present invention to provide a blade retaining mechanism wherein the maximum load bearing capacity of the retaining mechanism is not limited by the available space between the rotor blade tang and the rotor disc slot.

These and other objectives which will become apparent hereinafter are accomplished by the present invention which, briefly stated, provides for an assembly for locking radially extending blades in a rotor disc associated with a gas turbine engine. The assembly includes a pair of spaced apart lugs axially extending from one side of the disc to form an access gap for insertion of the blade tang into a dovetail slot in the periphery of the rotor disc. The lugs have at least one radially inwardly facing abutment surface. A pair of axially aligned opposed inwardly facing recesses one of which is disposed in one of said lugs and the other of which is disposed in the other of said lugs are disposed so as to open into said gap. A retaining member resides in the pair of recesses and extends across the gap so as to preclude egress of the blade tang from the dovetail slot. The retaining member includes at least one axially extending protrusion adapted to radially overlap and abuttingly engage the radially inwardly facing abutment surface on the pair of lugs. The assembly may further include a locking ring having a support flange in engagement with the retaining member. The assembly may further include resilient means for maintaining the retaining member in the pair of recesses when the support flange is not in engagement with the retaining member. The retaining assembly may be further comprised of protrusion means and detent means wherein said resilient means includes said protrusion means and the retaining member includes said detent means. The aforementioned radially inwardly facing abutment surface maybe disposed at the radially innermost ends of said pair of lugs. The retaining member may also include forward and aft facing abutment faces where said aft abutment face is in load receiving engagement with the blade tang and the forward facing abutment face is in load transferring engagement with said pair of lugs. The pair of recesses may be formed with first and second inwardly facing tapered side walls adapted to engage first and second outwardly facing tapered side walls on said retaining member.

BRIEF DESCRIPTION OF THE DRAWINGS

While the specification concludes with claims particularly pointing out and distinctly claiming the subject matter of the present invention, the invention will be more fully understood from the following description of the preferred embodiments which is given by way of example with the accompanying drawings wherein:

DETAILED DESCRIPTION OF THE PREFERRED EMBODIMENT

Figure 1:
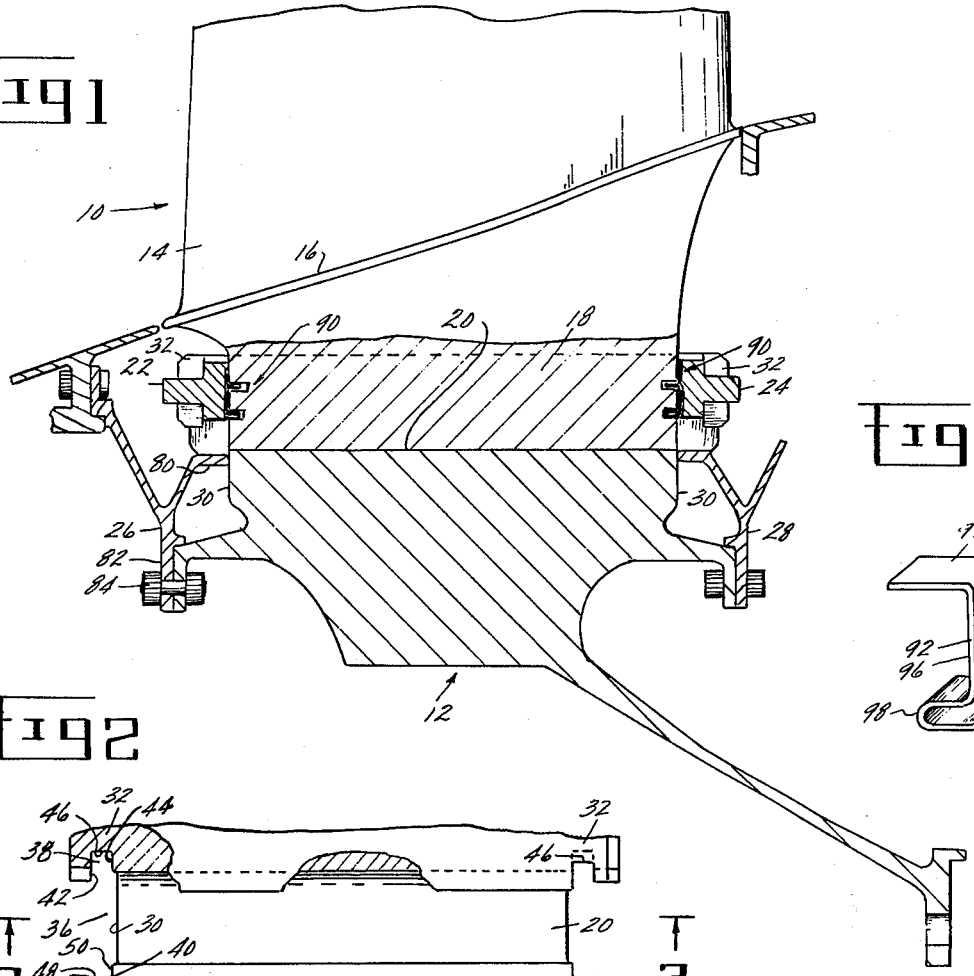
FIG. 1 is a partial cross-sectional view of the blade retaining assembly depicted as associated with a rotor blade and rotor disc.

Referring now to FIG. 1 of the drawings, a rotor blade shown generally at 10 is depicted in combination with a rotor disc shown generally at 12, both of which during operation rotate about an axis of rotation. Since FIG. 1 depicts a cross-sectional view of rotor disc 12 only one blade 10 is viewed. It should be understood however that rotor disc 12 is annular and extends circumferentially for 360°. It should be further understood that a plurality of rotor blades 10 are disposed about the periphery of disc 12 in a manner hereinafter to be described. Rotor blade 10 having a large radial dimension, is comprised of an airfoil 14, a platform 16 and a radially inwardly extending tang 18. Rotor dovetail slot 20, extending axially across the periphery of rotor disc 12, receives blade tang 18 which is held therein by a pair of retaining members 22, 24 disposed at the forward and aft extremities of dovetail slot 20. While only one blade 10 and one slot 20 are shown, it should be understood that a plurality of dovetail slots 20 disposed in the periphery of rotor disc 12 each receive the respective blade tang 18 of one of the aforementioned plurality of rotor blades 10. Locking rings 26 and 28 engage retaining members 22 and 24 respectively and themselves are fixedly secured to rotor disc 12. Since retaining member 22 and locking ring 26 cooperate to prevent blade tang 18 from emerging from the forward end of slot 20 in the same manner as retaining member 24 and locking ring 28 prevent the blade tang from emerging from the aft end of slot 20, the description of the present invention will be rendered more concise by describing the present invention embodied by retaining member 22 and locking ring 26.

Figure 2:
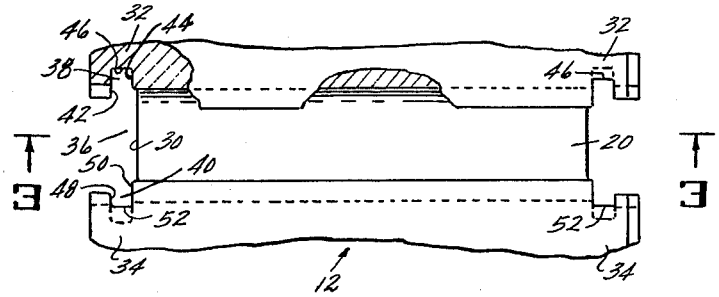
FIG. 2 is a top view of a portion of the rotor disc showing a dovetail slot, lugs and access gap associated with the present invention.

Referring now to FIG. 2 which depicts a top view of a portion of rotor disc 12, one of the aforementioned dovetail slots 20 is observed extending axially across the periphery of rotor disc 12 and terminating at forward face 30 of rotor disc 12. A pair of circumferentially spaced lugs 32 and 34, projecting in the axially forward direction from face 30, are disposed forward of and circumferentially adjacent to dovetail slot 20 to form an access gap 36 for insertion of blade tang 18 into dovetail slot 20.

A pair of circumferentially spaced apart recesses 38 and 40, disposed in lugs 32 and 34 respectively, open into access gap 36 and are in axial and radial alignment with each other. Recess 38 is comprised of aft facing recess wall 42, forward facing recess wall 44 and a circumferentially facing side wall 46 disposed therebetween. Recess 40 is comprised of aft facing recess wall 48, forward facing recess wall 50 and circumferentially facing side wall 52 disposed therebetween. Side walls 46 and 52 face toward each other and, for purposes hereinafter to be described, are tapered such that the spacing between the walls decreases in the radially outwardly direction.

Figure 3:
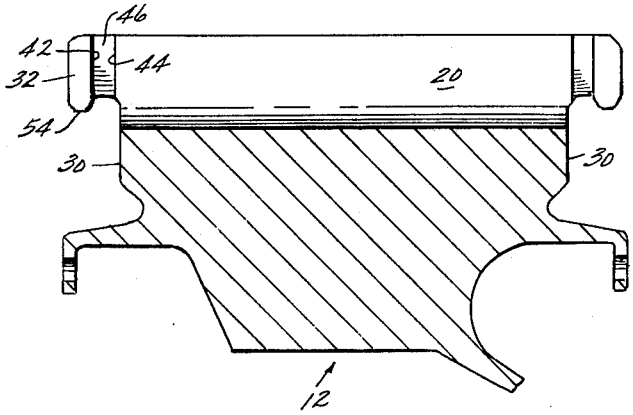
FIG. 3 is a cross-sectional view of the structure depicted in FIG. 2 taken along line 3—3 thereof.

Referring to FIG. 3, a cross-sectional view of rotor disc 12 taken along line 3—3 is shown. Radially inwardly facing and circumferentially and axially extending abutment surface 54 is disposed on lug 32 at the radially innermost end thereof. Similarly, radially inwardly facing and circumferentially and radially extending abutment surface 55 is disposed on lug 34 at the radially innermost end thereof as best viewed in FIG. 4.

Figure 4:
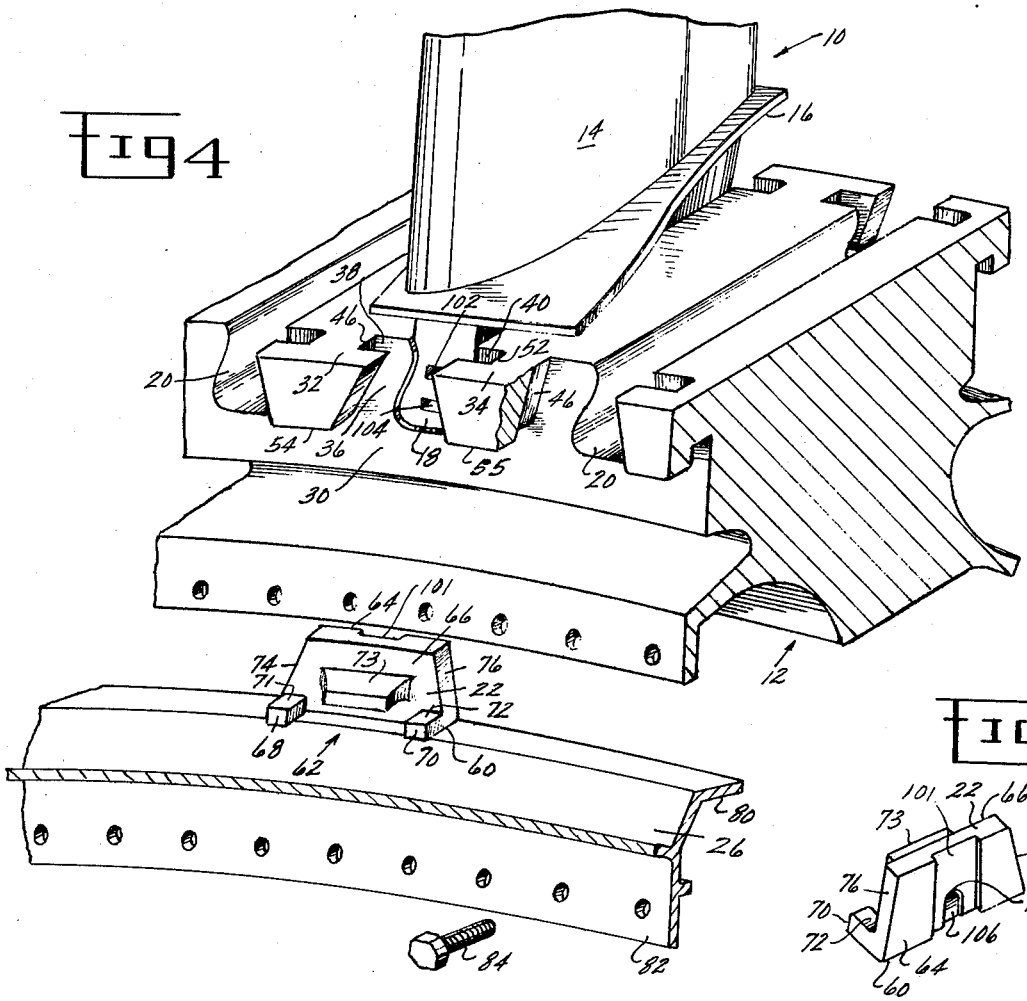
FIG. 4 is a perspective exploded view of the blade retaining assembly associated with the rotor blade and rotor disc.
Figure 5:
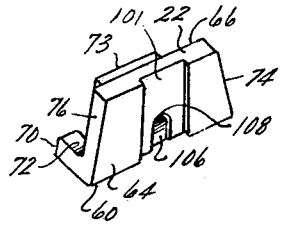
FIG. 5 is a perspective view of the retainer comprising a portion of the retaining assembly.

As best viewed in FIGS. 4 and 5, retaining member 22 is comprised of a flat generally trapazoidal base portion 60, having a relief 62 cut therein, and an aft abutment face 64 and a forward abutment face 66 disposed on opposite sides of base portion 60. Depending from forward abutment face 66, a pair of circumferentially spaced apart protrusions 68 and 70 project axially in the forward direction. Protrusions 68 and 70 are provided with bearing surfaces 71 and 72 respectively. As will more fully hereinafter be described bearing surfaces 71, 72 face in the radially outward direction when inserted into the rotor disc assembly and overlap and abuttingly engage radially inwardly facing abutment surfaces 54 and 55 on lugs 32 and 34 respectively to carry the centrifugal load of member 22. Also projecting axially forward is internal stiffening rib 73 generally centrally located on and depending from forward abutment face 66 for providing resistance to deformation of retaining member 22.

Disposed at opposite lateral sides of rtaining member 22 are tapered outwardly facing side walls 74 and 76. Outwardly facing side walls 74 and 76 on retaining member 22 are in close proximity to inwardly facing side walls 46 and 52 respectively of lugs 32 and 34. As will be more fully hereinafter described, side walls 74, 76 will abuttingly engage side walls 46, 52 in event of failure of protrusions 68 and 70 of member 22.

FIG. 4 depicts an exploded perspective showing a segment of rotor disc 12 rotor blade 10, retaining member 22 and locking ring 26. Rotor disc 12 as shown includes a plurality of dovetail slots 20 into one of which is inserted blade tang 18 of rotor blade 10. For purposes of illustration only one rotor blade 10 is exhibited in FIG. 4 but it should be understood that in the fully assembled stage a plurality of rotor blades 10 are associated with rotor disc 12 with each blade 10 residing in one of the aforementioned slots 20.

Blade 10 rsides in dovetail slot such that it extends across the periphery of rotor disc 12 and terminates at the forward face 30 of disc 12. Circumferentially spaced apart lugs 32 and 34 extend axially in the forward direction from face 30 to form access gap 36. As hereinbefore described, a pair of spaced apart recesses 38 and 40 are disposed adjacent access gap 36 with access 38 on one side of gap 36 and recess 40 on the other side of gap 36.

Retaining member 22 is assembled in the following manner after insertion of blade 10 into dovetail slot 20. Retaining member 22 is inserted into gap 36 at a radial distance sufficient for it to pass between lugs 32 and 34 until aft facing abutment face 64 engages forward face 30 of rotor disc 12. Retaining member 22 is then moved radially outward in direction of the blade 10 until bearing surfaces 71 and 72 associated with protruding legs 68 and 70, respectively engage and abut radially inwardly facing abutment surfaces 54 and 55 on lugs 32 and 34 respectively. In this position, retaining member extends completely across gap 36. Due to the overlapping relationship between bearing surfaces 71 and 72 and lugs 32 and 34 retaining member 22 is held against further movement radially outward during centrifugal loading associated with rotation of rotor disc 12 under operating conditions. In order to lock retaining member 22 in place in gap 36, locking ring 26 is disposed adjacent and immediately radially inward of retaining member 22 such that its annularly extending and axially aft projecting support flange 80 is in engagement with the radially innermost portions of protruding legs 68 and 70. Locking ring 26 is then secured at its annular circumferentially extending mounting flange 82 to rotor disc 12 by bolts 84.

With retaining member 22 inserted into gap 36 and locked in place by lock ring 26, blade 10 is prevented from migrating from dovetail slot 20. Aerodynamic and centrifugal forces exerted on blade 10, which would otherwise tend to urge blade tang 18 out of dovetail slot 20, are transferred to retaining member 22 by dovetail tang 18 at its abutment with aft abutment face 64 of retaining member 22. These loads are then absorbed by lugs 32 and 34 through the engagement of forward abutment face 66 on retaining member 22 with aft facing recess walls 42 and 48 on lugs 32 and 34 respectively. In this manner then external loads on blade 10 are transferred to retaining member 22 and thence to disc 12. Since retaining member 22 does not at any time reside in dovetail slot 20 and hence is not constrained in its geometrical configuration by space limitations between blade tang 18 and slot 20, retaining member 22 may be fabricated of a more desirable and ruggedized design with increased thickness and cross-sectional area to withstand stress imposed by high force loadings.

In the event protrusions 68 and 70 on retaining member 22 would become damaged or broken away from retainer 22 such that they are no longer capable of holding retaining member 22 against movement radially outward under the centrifugal loads associated with the rotating disc 12, backup means have been provided for accomplishing this function. More specifically, upon such an occurrence, tapered outwardly facing side walls 74 and 76 on retaining member 22 will engage inwardly facing side walls 46 and 52 on lugs 32 and 34. Such engagement will prevent further movement of retaining member 22 out of gap 36.

Another aspect of the present invention will be described. Since a plurality of retaining members 22 are associated with rotor disc 10, during assembly each retaining member 22 must be held temporarily from falling out of their respective gap 36 while the sother retaining members 22 are inserted into their respective gaps 36 at which time locking ring 26 may be installed to permanently lock all retaining members 22 in place. This is accomplished in the present invention by resilient means associated with each individual retaining member 22.

Figure 6:
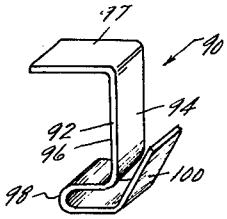
FIG. 6 is a perspective view of a spring clip comprising part of the retaining assembly.

Referring now to FIG. 6 a spring shown generally at 90 is comprised of a flat elongated central portion 92 having substantially flat parallel sides 94 and 96. First and second legs 97 and 98 depend from opposite ends of central portion 92 and away from central portion 92 in substantially the same direction. Second leg 98 is comprised of a substantially U-shaped cross section. A third protruding leg, leg 100, depends from second leg 98 and away from central portion 92 in a direction generally opposite from that in which legs 97 and 98 extend.

Protruding leg 100 is adapted to be movable from a first position to a second position under load wherein it is substantially parallel to flat side 94. With leg 100 in the second position, spring 90 is adapted to cooperate with detent means 106 in retaining member 22 to maintain retaining member 22 in gap 36.

Figure 7:
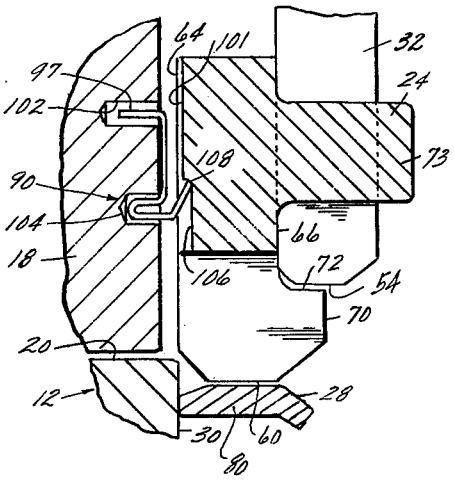
FIG. 7 is an enlarged cross-sectional view of the spring clip shown in FIG. 6 associated with other portions of the retaining assembly.

As best viewed in FIG. 7, spring 90 is installed between rotor blade tang 18 and retaining member 22. Spring 90 is inserted into gap 36 such that first and second legs 97 and 98 are received in slots 102 and 104, respectively, in blade tang 18. Retaining member 22 is then inserted into gap 36 and moved radially outward until protrudisng leg 100 snaps into detent 106 disposed in retaining member 22. Retaining member 22 is thereby securely held in gap 36 until the other of the plurality of retaining members 22 can be installed in their respective gaps 36 and locking ring 26 bolted in place.

Detent 106 is comprised of a very shallow depression in relief 101 of retaining member 22 and includes a step 108 between the bottom of detent 106 and the surface of relief 101. Step 108 cooperates with protruding leg 100 to maintain retaining member 22 disposed within gap 36. Disassembly is accomplished by depressing leg 100 toward blade tang 18 to remove it from engagement with step 108. Member 22 is then released and may be removed radially inward from gap 36.

From the foregoing it is now apparent that a retaining device arrangement has been provided which is well adapted to fulfill the aforestated objects of the invention, and that while an embodiment of the invention has been described for purposes of illustration, it will be apparent that other equivalent forms of the invention are possible within the scope of the appended claims.

Having thus described the invention, what is claimed as new and useful and desired to be secured by a U.S. Letters Patent is:

1. A blade retaining assembly for locking radially extending blades in a rotor disc associated with a gas turbine engine, each blade having a dovetail tang at its radially inward end and the rotor disc having dovetail slots extending axially across its periphery, each dovetail tang being received in one of said slots, said assembly comprising:

a pair of lugs axially extending from one side of said disc and disposed adjacent said slot and circumferentially spaced apart from each other to form an access gap for insertion of said blade tang into said dovetail slot, said pair of lugs having at least one radially inwardly facing abutment surface;

a pair of axially aligned opposed inwardly facing recesses, one of said pair of recesses disposed in one of said pair of lugs and opening into said gap and the other of said pair of recesses disposed in the other of said pair of lugs and opening into said gap;

a retaining member residing in said pair of recesses and extending across said gap so as to preclude egress of said blade tang from said dovetail slot, said retaining member including at least one axially extending protrusion adapted to radially overlap and abuttingly engage said radially inwardly facing abutment surface on said pair of lugs.

2. The blade retaining asembly as set forth in claim 1 futher including a locking ring rigidly secured to said disc, said locking ring having a support flange adapted to engage said retaining member for maintaining said retaining member in residence in said pair of recesses.

3. The blade retaining assembly as set forth in claim 2 further comprising resilient means for maintaining said retaining member in said pair of recesses when said support flange is not in engagement with said retaining member.

4. The blade retaining assembly as set forth in claim 3 further comprising protrusion means and detent means cooperating to maintain said retaining member in said pair of recesses when said support flange of said locking ring is not in engagement with said retaining member.

5. The blade locking asembly as set forth in claim 4 wherein said resilient means is disposed between said blade tang and said retaining member and said resilient means includes said protrusion means and said retaining member includes said detent means.

6. The blade retaining assembly as set forth in claim 1 wherein said radially inwardly facing abutment surface is disposed at the radially innermost ends of said pair of lugs and said protrusion on said retaining means is disposed radially inwardly of said inwardly facing abutment surfaces.

7. The blade locking assembly as set forth in claim 6 wherein said retaining member includes an aft facisng abutment face and a forward facing abutment face, said aft facing abutment face in load receiving engagement with said blade tang and said forward facing abutment face in load transferring engagement with said pair of lugs.

8. The blade locking assembly as set forth in claim 7 wherein said pair of recesses includes first and second inwardly facing tapered side walls adapted to engage first and second outwardly facing tapered side walls on said retaining member.

* * * * *